US005625928A

United States Patent [19]

Terada et al.

[11] Patent Number: 5,625,928

[45] Date of Patent: May 6, 1997

[54] AUTOMATIC LOCK SLIDER FOR SLIDE FASTENER

[75] Inventors: Yasuharu Terada; Tsunetaka Aoki, both of Toyama, Japan

[73] Assignee: YKK Corporation, Tokyo, Japan

[21] Appl. No.: 418,000

[22] Filed: Apr. 6, 1995

[30] Foreign Application Priority Data

May 26, 1994 [JP] Japan ..... 6-112414

[51] Int. Cl.[6] ..... A44B 19/30

[52] U.S. Cl. ..... 24/424; 24/421

[58] Field of Search ..... 24/424, 421

[56] References Cited

U.S. PATENT DOCUMENTS

| | | | |
|---|---|---|---|
| 2,450,550 | 10/1948 | Griffin et al. | 24/424 |
| 2,699,588 | 1/1955 | Carlile | 24/424 X |
| 3,813,736 | 6/1974 | Fukuroi | 24/424 |
| 4,048,699 | 9/1977 | Kanzaka | 24/421 |
| 4,102,022 | 7/1978 | Aoki | 24/424 |
| 4,139,928 | 2/1979 | Aoki et al. | 24/424 |
| 4,287,646 | 9/1981 | Kanzaka | 24/424 |
| 4,667,376 | 5/1987 | Ishii et al. | 24/424 X |
| 5,400,481 | 3/1995 | Oda | 24/424 |

FOREIGN PATENT DOCUMENTS

| | | | |
|---|---|---|---|
| 404271 | 6/1966 | Switzerland | 24/424 |

*Primary Examiner*—Peter M. Cuomo
*Assistant Examiner*—Robert J. Sandy
*Attorney, Agent, or Firm*—Hill, Steadman & Simpson

[57] ABSTRACT

In an automatic lock slider for a slide fastener, a yoke accommodating a locking pawl and a leaf spring has a pair of inwardly directed projections, and a generally C-shaped, narrow rigid strip has on its upper edges a pair of taper surfaces corresponding to the respective projections. As the taper surfaces are guided by the projections, the pawl keeps its suitable posture during the assembling of the slider, and the pawl acts reliably while the automatic locking mechanism is either operative or inoperative. The locking pawl is small in width and has one leg portion to be inserted in a groove of the outer surface of a connector of a slider body. The result is that the number of pressing steps is reduced to minimize press traces on the surface of an upper wing of the slider body so that press traces are prevented from coming out on the slider surface though the yoke is smaller in width compared to the conventional one.

10 Claims, 4 Drawing Sheets

AUTOMATIC LOCK SLIDER FOR SLIDE FASTENER

BACKGROUND OF THE INVENTION

1. Field of the Invention

This invention relates to an automatic lock slider for a slide fastener, and more particularly to an automatic lock slider in which at least a slider body is formed by pressing and a locking pawl and its associated part are compactly accommodated and secured in a yoke so that smooth assembling can be achieved.

2. Description of the Related Art

In assembling this type of automatic lock slider, a pull tab, a generally C-shape resilient locking pawl and a yoke are attached to a slider body composed of upper and lower wings joined together at one ends by a connector (i.e. a diamond portion). Some parts sum as the slider body and the pull tab may be formed by pressing or die casting. Further, the locking pawl should by no means be limited to having a resiliency by itself and may have an associated spring as a separate member.

A machine for pressing slider bodies is currently known as disclosed in, for example, Japanese Patent Publication No. SHO 31-5628. An example of the slider body formed by pressing is disclosed in Japanese Utility Model Publications Nos. SHO 56-45447 and 58-3527. In the slider body disclosed in these Japanese Utility Model Publications, an upper wing has, in addition to an aperture through which one end of a locking pawl is to be inserted, a plurality of projections and recesses, which are formed by pressing, in order to position the pawl before the yoke is attached to the slider body and for stabilization of the pawl posture. In the meantime Japanese Utility Model Publications Nos. SHO 55-17846 and 58-3527 describe the concept of holding part of a locking pawl in a box-like yoke, which is formed by pressing, by clenching or pressing opposite side walls of the yoke.

However, regardless of whether or not it is integral with the spring, the locking pawl, as disclosed in the foregoing prior art references, is in the form of a metal strip having a width greater than the width essentially needed for the pawl. As long as the locking pawl has an adequate degree of strength to ensure engagement with and disengagement from coupling elements of the slide fastener in response to the movement of the pull tab, it is preferable to reduce the size of the locking pawl to a minimum since the locking pawl is mounted on the upper surface of the upper wing and the locking pawl is received in the box-like yoke.

Nevertheless, the conventional locking pawls have a large width in order to have one end of the pawl bifurcated and to prevent the pawl from falling sideways during assembling so that automatic assembling can be achieved. Further, the upper wing of the slider body has on its upper surface a plurality of projections and recesses to support the bifurcated end of the pawl to stabilize the posture of the pawl during assembling.

As a matter of course, these projections and recesses have to be prevented from being exposed to the slider surface and it is hence inevitable to cover them together with the locking pawl so that the yoke has necessarily a large width compared to the essentially needed size. This somehow influences on the appearance of the slider.

Further, if the slider body is formed by pressing, the problem in outside view would become more serious. In pressing process, mere bending and punching would not have caused any problem, however, pressing the slider body to provide the above-mentioned projections and recesses would cause plastic deformation around the pressed areas. Consequently in order to prevent any plastic deformation during the pressing, the slider body had to be firmly clamped around the areas to be pressed. As a result, traces due to the clamping would leave around the pressed areas. These traces are too large to be entirely covered by the yoke as the width of the yoke has a limit. So the traces partly come out on the slider surface to give the product an unsightly appearance.

SUMMARY OF THE INVENTION

It is therefore an object of this invention to secure positioning of a locking pawl and stabilizing of its posture during pressing and assembling and hence to provide an automatic lock slider which has a smooth neat surface with no press traces not only on the surface of a yoke, which has a width reduced to a minimum, but also on the exposed upper surface of the upper wing of a slider body.

According to a first aspect of the invention, the above object is accomplished by an automatic lock slider for a slide fastener, comprising: a slider body composed of upper and lower wings joined together by a connector, the upper wing having an aperture; a generally C-shape locking pawl mounted on the slider body astride of a part of a pull tab; a leaf spring resiliently pressing the pawl against the upper wing; and a yoke accommodating the pawl and the leaf spring and pivotally supporting the pull tab. In the lock slider, the slider body is formed by pressing in such a manner that the upper wing has a smooth surface with no burrs due to the pressing. The pawl is in the form of a narrow-width rigid strip. According to a second aspect of the invention, the above object is accomplished by an automatic lock slider for a slide fastener, comprising: a slider body composed of upper and lower wings joined together by a connector, the upper wing having an aperture; a generally C-shape locking pawl mounted on the slider body astride of a part of a pull tab; a leaf spring resiliently pressing the pawl against the upper wing; and a yoke accommodating the pawl and the leaf spring and pivotally supporting the pull tab. In the lock slider, the slider body is formed by pressing. The yoke has a pair of confronting projections which extend from opposed inner wall surfaces of the yoke, have a space between each other and guide the pawl from opposite sides so as to restrict falling of the pawl. And the pawl is a rigid strip. Preferably the pawl has taper surfaces at upper edges of the pawl for frictional engagement with the respective projections. Also preferably, one end of the pawl is fitted in an anchor groove formed in an outer edge of the connector of the slider body. Further preferably, the yoke includes an anchor leg portion to be secured in a yoke-securing groove formed in the connector of the slider body.

For assembling the slider of this invention, firstly a ring-shape end of the pull tab is placed on the upper surface of the upper wing of the slider body at a predetermined position, and then the pawl is tentatively set on the slider body so as to be astride of the ring-shape end. At that time, an attachment portion of the pawl is inserted in the anchor groove formed in the connector of the slider body while a claw portion of the pawl is loosely inserted in the aperture of the upper wing. In this posture, a distal end of the claw portion projects into an element guide channel of the slider body so as to engage with coupling element rows. While the pull tab and the pawl are thus set on the slider body, the leaf spring is received in the yoke and is then supported from the lower side by confronting projections extending from the cutouts of the opposite side walls of the yoke.

Then, the yoke holding the leaf spring is attached to the slider body on which the pull tab and the pawl have been set. One end of the yoke is inserted into a vertical groove formed in the outside of the connector of the slider for securing the yoke, and the other end of the yoke is secured to the slider body at the other end remote from the connector. At that time, even if the tentatively set pawl assumes a slightly laterally inclined posture, the pawl is introduced into the gap between the confronting projections to stand up as the opposite taper surfaces formed on the upper edge of the pawl are guided by the projections so that the leaf spring received in the yoke resiliently presses the upper surface of the pawl accurately.

Subsequently, the open end of the yoke-securing groove is clenched from opposite sides to fixedly hold one end of the yoke, and the other end of the yoke is fixed to the slider body. Thus the assembling of the slider is completed. With the resulting slider of this invention, although the locking pawl received in the yoke, unlike the conventional wide pawl, is in the form of a very narrow rigid strip, which is hard to keep its predetermined posture, the opposite taper surfaces formed on the upper edges of the pawl are guided by the confronting projections when the pawl is moved by the pull tab, so that engagement and disengagement of the pawl with the coupling element rows can take place reliably.

Further, partly since the locking pawl has a small width through its entire length and partly since the upper wing of the slider body is pressed to a minimum extent, virtually no press trace would be left on the upper surface of the upper wing, and the yoke may have a minimum size enough to conceal the pressed areas. As a result, it is possible to receive the pawl and the leaf spring compactly in the yoke. It is also possible to obtain a very sightly slider as there is no press traces on the outer surface of the upper wing of the slider body, regardless of the small-width yoke compared to the conventional wide yoke.

DETAILED DESCRIPTION OF THE PREFERRED EMBODIMENT

Figure 1:
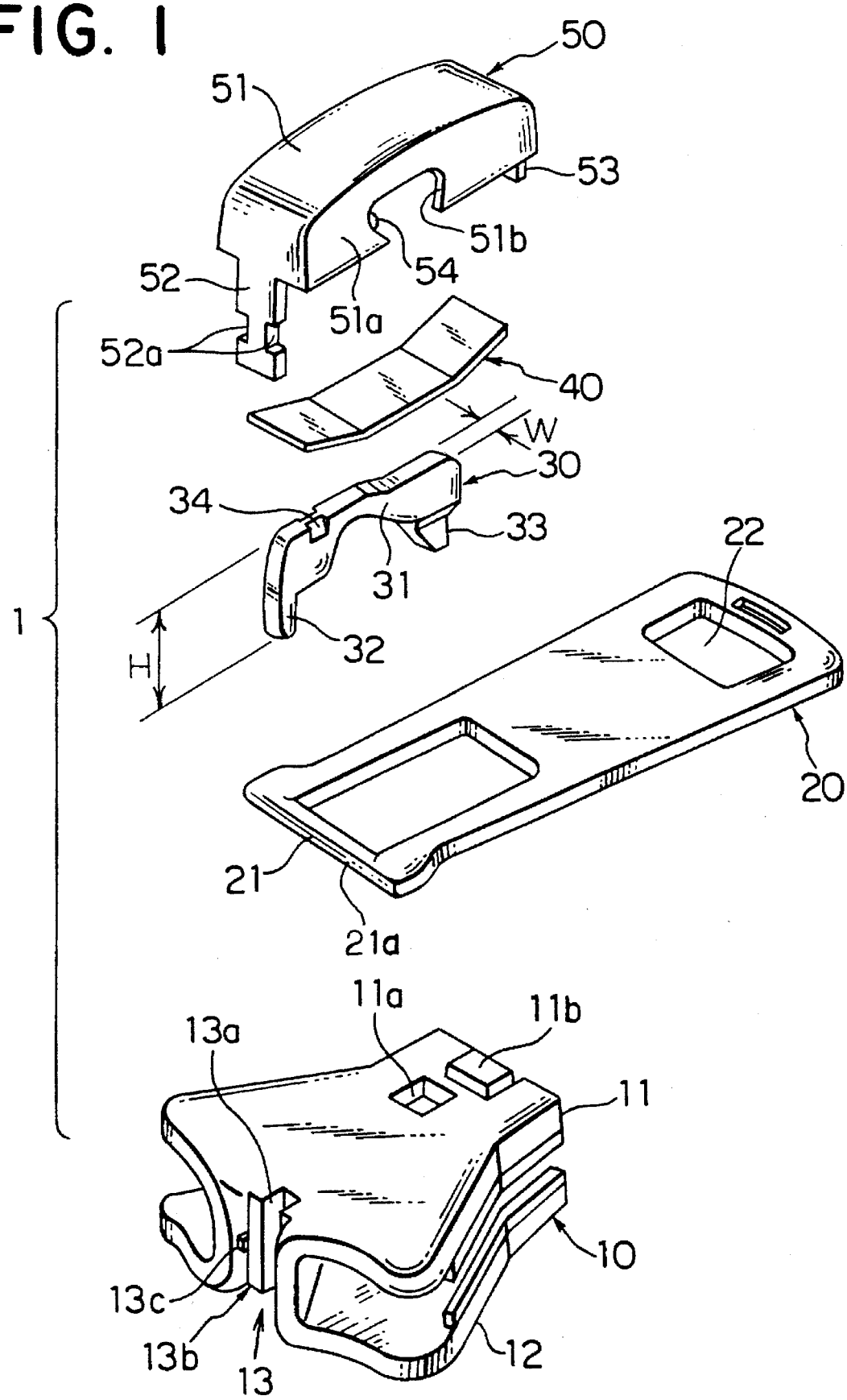
FIG. 1 is an exploded perspective view of an automatic lock slider, for a slide fastener, according to a typical embodiment of this invention.

A typical embodiment of this invention will now be described with reference to the accompanying drawings. FIG. 1 is an exploded perspective view of an automatic lock slider according to the embodiment of this invention. The automatic lock slider 1 has a slider body 10 composed of upper and lower wings 11, 12 joined together by a connector 13 so as to define a generally Y-shape guide channel for guiding non-illustrated opposed coupling element rows of a slide fastener, the upper wing 11 having an aperture 11*a*. The slider 1 also includes a generally C-shape locking pawl 30 mounted on the slider body 10 astride a bar portion 21*a* of a ring-shape end 21 of a pull tab 20, a spring 40 for resiliently pressing the pawl 30 against the upper surface of the upper wing 11, and a yoke 50 to which the pull tab 20 is pivotally attached for pivotal movement about the ring-shape end 21.

In the illustrated embodiment, the whole of the slider body 10 is shaped by pressing, and the connector 13 has in and along its outer edge a vertical anchor groove 13*a* in which one end of the pawl 30 is to be inserted, and a vertical yoke-securing groove 13*b* in which one end of the yoke 50 is to be inserted and secured, the yoke-securing groove 13*b* opening outwardly in step from the anchor groove 13*a* and having a width greater than that of the anchor groove 13*a*. These two grooves 13*a*, 13*b* are formed simultaneously with the press shaping of the connector 13. The yoke-securing groove 13*b* has on opposite side walls a pair of inwardly directed first projections 13*c* which are also formed by pressing. Further, the upper wing 11 has at one end toward the aperture 11*a* a yoke-attachment portion 11*b*, which is formed by pressing, for securing the other end of the yoke 50 by clenching.

One of significant features of this invention is that the aperture 11*a* and the yoke-attachment portion 11*b* are formed in and on the upper wing of the slider body 10 by press shaping. Since the aperture 11*a* is formed merely by punching, press traces are made only around the pressed areas. And since the yoke-attachment portion 11*b* is open at one end, there hardly are shaping traces. Further, since these pressed portions are completely concealed by the yoke 50, there are no unsightly areas on the upper surface of the upper wing around the yoke 50.

The pull tab 20 is in the form of a generally rectangular metal strip shaped by pressing as conventional, having at one end a ring-shape end 21 with a rectangular hole and at the other end a rectangular hole 22. The spring 40 is a leaf spring having a simplest shape as conventional. If the pawl and the leaf spring are formed in a single-member structure as conventional, it necessarily have a large width. Whereas in this invention, since the pawl 30 and the leaf spring 40 are separate members, it is possible to reduce the width of the two-member structure to an essential minimum size so that the width of the box-shape yoke 50 also can be reduced drastically.

In this invention, the pawl 30 constitutes one of important components of the slider. As is understood from FIG. 1, the pawl 30 itself is not resilient at all. Specifically, the pawl 30 is in the form of a generally C-shape metal strip which has a minimum width enough to secure required rigidness and strength and which is formed by punching, die casting etc. The overall height dimension H is greater than the overall width dimension W. The height dimension H is taken perpendicular to the upper wing 11 and the width dimension W is taken perpendicular to the height dimension H and parallel to the bar portion 21*a* of the ring-shaped end 21. The pawl 30 has at its rear end (i.e. left-side of FIG. 6) an attachment leg 32 to be attached to the slider body 10 and having a thickness substantially equal, to that of a pawl body 31, and at its front end a claw portion 33 laterally off the center of the pawl body 31. The reason why the claw portion 33 is located in an ecentric position is that the claw portion 33 can engage in the gap between leg portions of adjacent elements of one of non-illustrated opposed element rows coupled as guided in the element guide channel of the slider body 10, preventing the slider 1 from sliding on the coupling elements when the pull tab is freed.

Another characteristic feature of the pawl 30 is that the pawl body 31 has a pair of taper surfaces 34 in a part of each of the upper edges of opposite sides. These taper surfaces 34 serve to automatically keep the pawl 30 in an upright position during the slider assembling as guided between confronting second projections 54 (described below) of the yoke 50.

The yoke 50 is in the form of a narrow elongated box-like body 51 as compared to the conventional structure, having at one end a first anchor leg portion 52 to be inserted in the yoke-securing groove 13*b* of the slider body 10 and at the other end a second anchor leg portion 53 to be secured to the upper wing 11 of the slider body 10 by clenching the yoke-attachment portion 11*b* formed on the upper wing 11. The first anchor leg portion 52 has a length enough to be inserted in the yoke-securing groove 13*b* and has in its opposite side edges a pair of first cutouts 52*a* in which the yoke-securing first projections 13*c* extending inwardly from the opposite side walls of the yoke-securing groove 13*b* are received.

Further, the box-like body 51 has substantially centrally in opposite side walls 51*a* a pair of second cutouts 51*b* through which the ring-shape attachment portion 21 of the pull tab 20 is pivotally attached so that the pull tab 20 can be pivotally moved in a predetermined angle. The box-like body 51 has also a pair of confronting second projections 54 extending from opposed laterally aligned edges of the second cutouts 51*b*. According to the illustrated embodiment, the second projections 54 extend parallel to the opposite side walls 51*a* before the slider 1 is assembled, and are bent inwardly after the leaf spring 40 is received in the box-like body 51 during assembling. Thus the leaf spring 40 can be attached in a simple operation and is supported by the opposed second projections 54. Of course, the leaf spring 40 may be placed in the box-like body 51 on which the second projections 54 extend inwardly. In automatic assembling, however, it is desirable to bend the second projections 54 after the leaf spring 40 is placed in the box-like body 51. The second projections 54 serves also to assist in positioning the pawl 30 and stabilizing its posture during assembling as mentioned above. For this purpose, the opposed second projections 54 are located at positions corresponding to the opposite taper surfaces 34 formed on the upper edges of the pawl 30.

Figure 2:
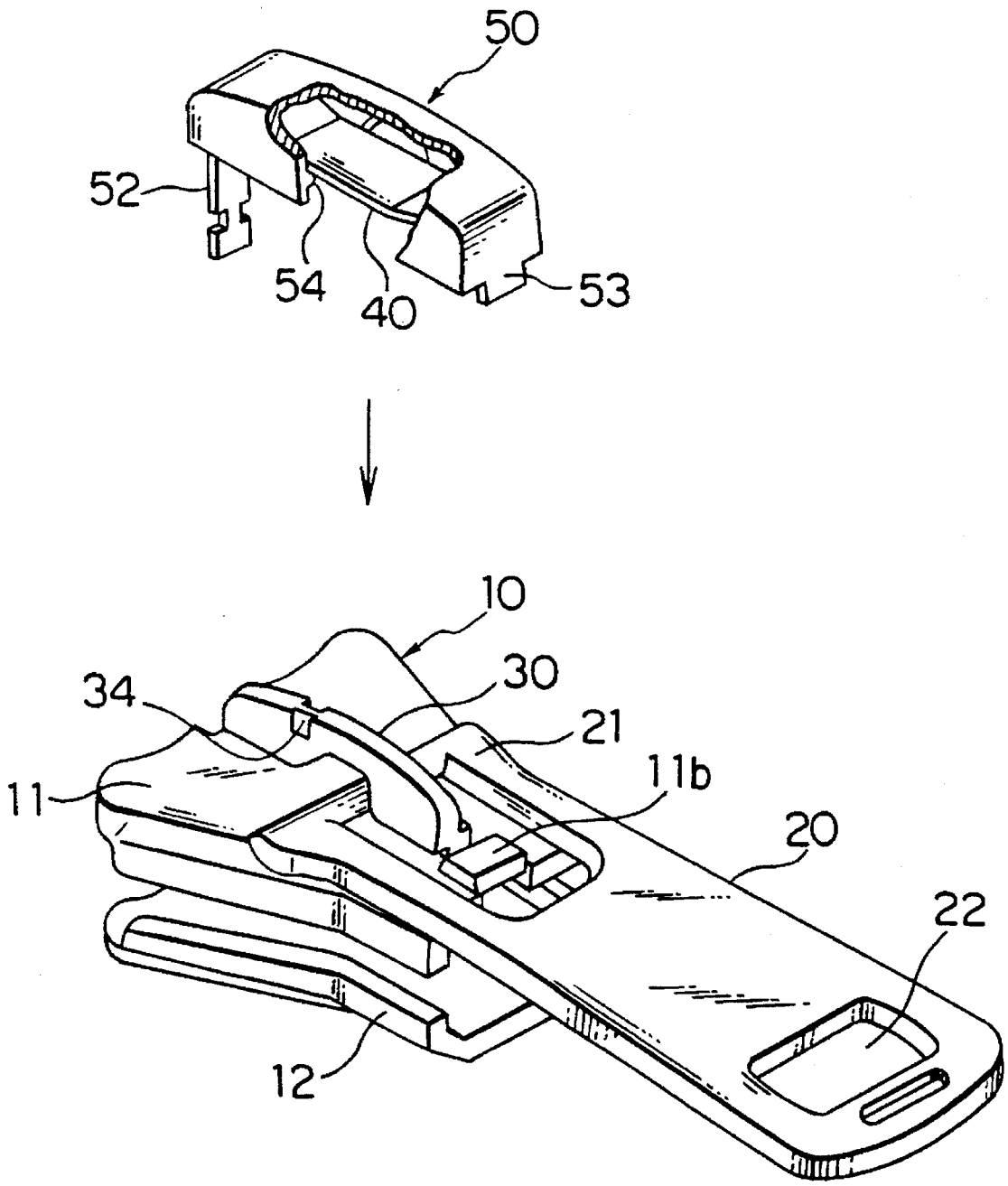
FIG. 2 is an exploded perspective view showing one of steps of assembling the slider.
Figure 3:
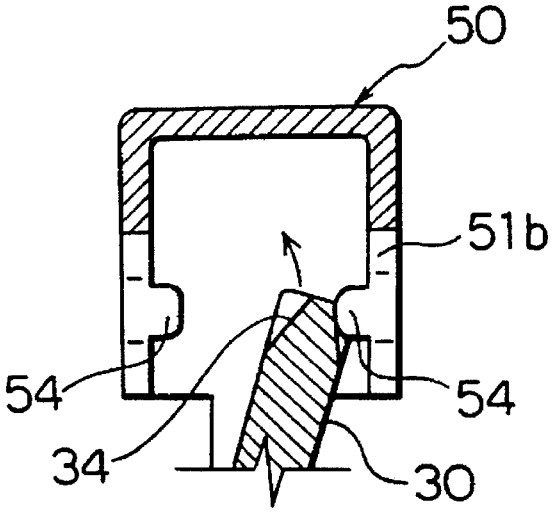
FIG. 3 shows the manner in which projections of a yoke and taper surfaces of a pawl coact in the slider.

FIG. 2 shows the manner in which the yoke 50 accommodating the leaf spring 40 is attached to the slider body 10 after the above-mentioned pull tab 20 and the pawl 30 are set on the slider body 10. Firstly the ring-shape attachment portion 21 of the pull tab 20 is placed substantially centrally on the upper wing 11 of the slider body 10, and then the pawl 30 is tentatively set on the slider body 10 astride of the ring-shape attachment portion 21. At that time, the attachment leg portion 32 of the pawl 30 is inserted in the anchor groove 13*a* formed in the connector 13 of the slider body 10, and the claw portion 33 is loosely inserted in the aperture 11*a*. In this posture, the distal end of the claw portion 33 projects into the element guide channel of the slider body 10 to engage non-illustrated coupling element rows. Thus while the pull tab 20 and the pawl 30 are set on the slider body 10, the leaf spring 40 is placed in the yoke 50. Then the opposed second projections 54 formed on the edges of the second cutouts 51*b* of the yoke 50 are bent inwardly toward each other to support the leaf spring 40 from opposite sides.

Then, the yoke 50 accommodating the leaf spring 40 as shown in FIG. 2 is attached from the upper side to the slider body 10 on which the pull tab 20 and the pawl 30 are set. The first anchor leg portion 52 of the yoke 50 is inserted in the yoke-securing groove 13*b* formed in the connector 13 of the slider body 10, and at the same time, the inner surface of the second anchor leg portion 53 is in contact with the outer surface of the yoke-attachment portion 11*b*. At that time, even if the tentatively set pawl 30 is somehow tilted laterally, it is introduced into the gap between the opposed second projections 54 to stand up as the taper surfaces 34 of the pawl 30 are guided by the second projections 54, so that the leaf spring 40 received in the yoke 50 comes into resiliently contact with the upper surface of the pawl 30.

Subsequently, the open end of the yoke-securing groove 13*b* of the connector 13 is clenched from the opposite sides to hold the first anchor leg portion 52 of the yoke 50, and the second anchor leg portion 53 of the yoke 50 is secured to the slider body 10 by bending inwardly into an L shape about the yoke-attachment portion 11*b*, thus the assembling of the slider 1 is completed. During this clenching, the yoke-securing first projections 13*c* extending from the opposite inner walls of the yoke-securing groove 13*b* are fitted in the respective first cutouts 52*a* of the first anchor leg portion 52 to keep the yoke 50 free from vertical movement.

Figure 4:
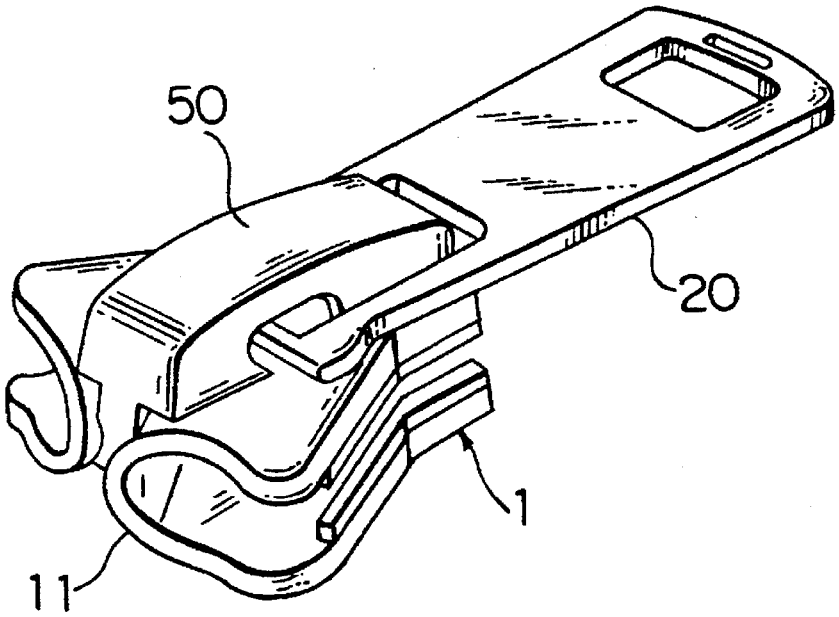
FIG. 4 shows an exterior view of the slider.
Figure 5:
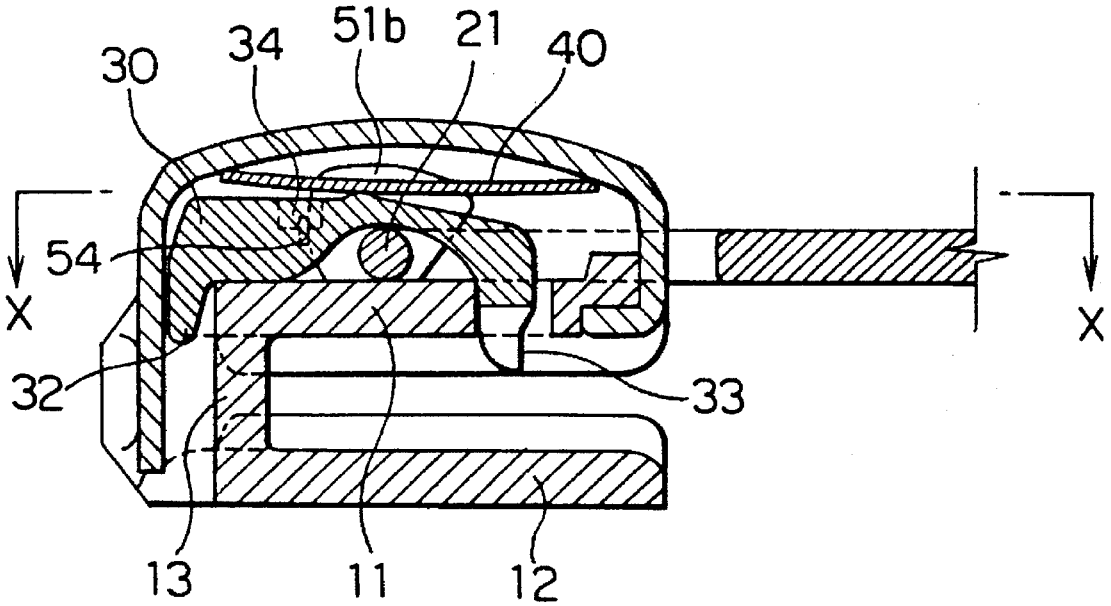
FIG. 5 is a longitudinal cross-sectional view of the slider.
Figure 6:
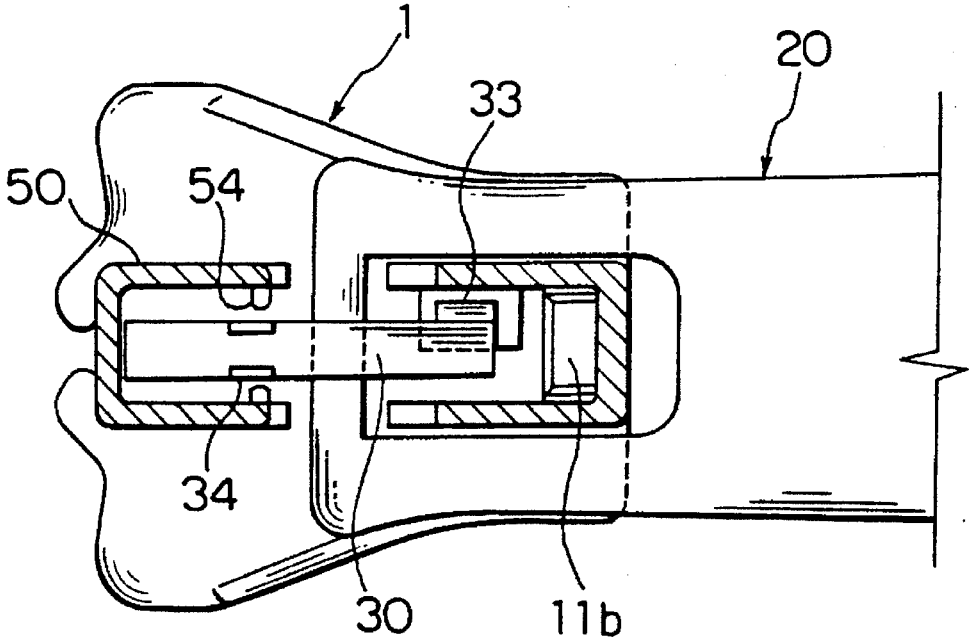
FIG. 6 is a cross-sectional view taken along line X—X of FIG. 5.

With the thus assembled slider 1 of this invention, although the pawl 30 received in the yoke 50 as shown in FIGS. 4 through 6, unlike the conventional wide pawl, is in the form of a very narrow rigid strip, its predetermined posture would be kept stable all the time as the lateral movement of the pawl 30 is restricted by the opposed second projections 54 when the pull tab 20 is freed, so that engagement and disengagement of the pawl 30 with and from the coupling element rows can take place reliably.

Further, partly since the pawl 30 has a small width through its entire length as mentioned above, and partly since only the aperture 11*a* and the yoke-attachment portion 11*b* of the upper wing 11 of the slider body 10 are formed by punching and pressing, there are left virtually no press traces on the surface of the upper wing 11 and hence the yoke 50 can have a minimum width enough to conceal the aperture 11*a* and the yoke-attachment portion 11*b*. As a result, the pawl 30 and the leaf spring 40 can be received compactly in the yoke 50, and even if the yoke 50 has a smaller width compared to that of the conventional yoke, no press traces would appear on the outer surface of the upper wing 11 of the slider body 10. It is accordingly possible to manufacture a slider 1 that is very sightly in appearance and neat in shape.

As is apparent from the foregoing detailed description, in the automatic lock slider of this invention, partly since the box-like yoke 50 has a pair of confronting second projections 54 extending inwardly from the opposite side walls 51*b* of the yoke 50, and partly since the locking pawl 30 has on its upper edges a pair of taper surfaces 34 corresponding to the second projections 54, the pawl 30 can be kept in a suitable posture during the slider assembling, though it is in a generally C-shaped strip small in width and excellent in strength, so that the pawl. 3O is prevented from falling sideways while the locking mechanism is either operative nor inoperative, thus realizing reliable engagement and disengagement of the pawl 3O with and from the coupling element rows.

Further, partly since the locking pawl 3O has a small width as mentioned above and partly since the distance between the anchor groove 13*a* and the claw portion 33 can be long enough because the attachment leg 32 is inserted and supported between the vertical anchor groove 13*a* formed in the outer side of the connector 13 of the slider body 10 and one leg portion 52 of the yoke 50, it is possible to enlarge the engaging and disengaging actions of the pawl 30 with respect to the coupling element rows so that the reliable automatic locking operation of the slider 1 by the pull tab 20 can be achieved. Furthermore, since the number of pressing steps for the upper wing 11 of the slider body 10 is reduced to a needed minimum, good productivity can be obtained, and occurrences of press traces on the upper wing surface can be avoided to the utmost. Accordingly, with the pawl 30 and the leaf spring 40 being separate members, the yoke 50 can be smaller in width and nicer in shape compared to the conventional yoke so that the resulting slider has a very sightly appearance with no press traces on the slider body surface.

What is claimed is:

1. An automatic lock slider for a slide fastener, comprising:

a slider body composed of upper and lower wings joined together by a connector, said upper wing having an aperture;

a pull tab;

a generally C-shape locking pawl mounted on said slider body astride of a part of said pull tab;

a leaf spring resiliently pressing said pawl against said upper wing; and a yoke accommodating said pawl and said leaf spring and pivotally supporting said pull tab;

said slider body being formed by pressing in such a manner that said upper wing has a smooth surface with no burrs due to the pressing, said pawl being in the form of a narrow-width rigid strip, said upper wing being smooth and flat from said aperture to a front edge thereof, said pawl having an attachment leg portion and claw portion, said attachment leg portion captured between said yoke and the front edge of said upper wing, said claw portion loosely protruding into said aperture.

2. An automatic lock slider for a slide fastener, comprising:

a slider body composed of upper and lower wings joined together by a connector, said upper wing having an aperture;

a generally C-shape locking pawl mounted on said slider body astride of a part of a pull tab;

a leaf spring resiliently pressing said pawl against said upper wing; and a yoke accommodating said pawl and said leaf spring and pivotally supporting said pull tab;

said slider body being formed by pressing, said yoke having a pair of confronting projections extending from opposed lateral inner wall surfaces of said yoke and having a space between said projections, said projections guiding said pawl from opposite sides so as to restrict falling of said pawl, and said pawl being a rigid strip, said pawl having an attachment leg portion and a claw portion, said attachment leg portion captured between said yoke and a front edge of said upper wing, said claw portion loosely protruding into said aperture.

3. An automatic lock slimier for a slide fastener, comprising:

a slider body composed of upper and lower wings joined together by a connector, said upper wing having an aperture;

a generally C-shape locking pawl mounted on said slider body astride of a part of a pull tab;

a leaf spring resiliently pressing said pawl against said upper wing; and a yoke accommodating said pawl and said leaf spring and pivotally supporting said pull tab;

said slider body being formed by pressing, said yoke having a pair of confronting projections extending from opposed inner wall surfaces of said yoke and having a space between said projections, said projections guiding said pawl from opposite sides so as to restrict falling of said pawl, and said pawl being a rigid strip;

wherein said pawl has taper surfaces at upper edges of said pawl for frictional engagement with the respective projections.

4. An automatic lock slider according to claim 2, wherein one end of said pawl is fitted in an anchor groove formed in an outer edge of said connector of said slider body.

5. An automatic lock slider for a slide fastener, comprising:

a Slider body composed of upper and lower wings joined together by a connector, said upper wing having an aperture;

a generally C-Shape locking pawl mounted on said slider body astride of a part of a pull tab;

a leaf spring resiliently pressing said pawl against said upper wing; and a yoke accommodating said pawl and said leaf spring and pivotally supporting said pull tab;

said slider body being formed by pressing, said yoke having a pair of confronting projections extending from opposed lateral inner wall surfaces of said yoke and having a space between said projections, said projections guiding said pawl from opposite sides so as to restrict falling of said pawl, and said pawl being a rigid strip, wherein said yoke includes an anchor leg portion to be secured in a yoke-securing groove formed in said connector of said slider body.

6. An automatic lock slider for a slide fastener, comprising:

a slider body composed of upper and lower wings joined together by a connector, said upper wing having an aperture;

a pull tab having a ring shaped end with a bar portion defining a terminus of said ring shaped end;

a generally C-shaped locking pawl mounted on said upper wing, astride said bar portion of said pull tab and having a claw portion passing through said ring shaped end and into said aperture of said upper wing, said claw portion for protruding between opposite engaging elements of the slide fastener for locking said automatic lock slider in place;

a leaf spring placed over said pawl and resiliently pressing said pawl against said upper wing;

a yoke, shaped as a concave element, having lateral side walls and mounted onto said upper wing retaining said pawl and said leaf spring therein, said yoke capturing said ring shaped end of said pull tab onto said upper wing and accommodating said bar portion through opposite lateral side wall apertures, said yoke providing protrusions extending from lateral sidewalls thereof inwardly, said protrusions terminating at distal ends within said yoke allowing a space between said distal ends for guiding said pawl into an upright orientation, said pawl having an attachment leg portion at an end opposite said claw portion, said attachment leg portion captured between said yoke and a front edge of said upper wing, said claw portion protruding through said aperture.

7. The automatic lock slider according to claim 6 wherein said pawl is fashioned as a narrow-width rigid strip having a greatest height dimension greater than its greatest width dimension said height dimension measured perpendicularly to a top surface of said upper wing and said width dimension measured perpendicularly to said height dimension and parallel to said bar portion.

8. An automatic lock slider for a slide fastener, comprising:

a slider body composed of upper and lower wings joined together by a connector, said upper wing having an aperture;

a pull tab having a ring shaped end with a bar portion defining a terminus of said ring shaped end;

a generally C-shaped locking pawl mounted on said upper wing, astride said bar portion of said pull tab and having a claw portion passing through said ring shaped end and into saint aperture of said upper wing, said claw portion for protruding between opposite engaging elements of the slide fastener for locking said automatic lock slider in place;

a leaf Spring placed over said pawl and resiliently pressing said pawl against said upper wing;

a yoke, shaped as a concave element, having lateral side walls and mounted onto said upper wing retaining said pawl and said leaf spring therein, said yoke Capturing said ring shaped end of said pull tab onto said upper wing and accommodating said bar portion through opposite lateral side wall apertures, said yoke providing protrusions extending from lateral sidewalls thereof inwardly, said protrusions terminating at distal ends within said yoke allowing a space between said distal ends for guiding said pawl into an upright orientation, wherein said pawl provides tapered indents at opposite upper edges for contact engagement with said projections during assembly of said yoke onto said upper wing, said tapered indentations for gradual guidance of said pawl into an upright orientation during assembly.

9. An automatic lock slider according to claim 6, wherein one end of said pawl is fitted in an anchor groove formed in an outer edge of said connector of said slider body.

10. An automatic lock slider for a slide fastener, comprising:

a slider body composed of upper and lower wings joined together by a connector, said upper wing having an aperture;

a pull tab having a ring shaped end with a bar portion defining a terminus of said ring shaped end;

a generally C-shaped locking pawl mounted on said upper wing, astride said bar portion of said pull tab and having a claw portion passing through said ring shaped end and into said aperture of said upper wing, said claw portion for protruding between opposite engaging elements of the slide fastener for locking said automatic lock slider in place;

a leaf spring placed over said pawl and resiliently pressing said pawl against said upper wing;

a yoke, shaped as a concave element, having lateral side walls and mounted onto said upper wing retaining said pawl and said leaf spring therein, said yoke Capturing said ring shaped end of said pull tab onto said upper wing and accommodating said bar portion through opposite lateral side wall apertures, said yoke providing protrusions extending from lateral sidewalls thereof inwardly, said protrusions terminating at distal ends within said yoke allowing a space between Said distal ends for guiding said pawl into an upright orientation, wherein said yoke includes an anchor leg portion to be secured in a yoke-securing groove formed in said connector of said slider body.

* * * * *